United States Patent [19]

Sheaffer

[11] Patent Number: 4,461,251

[45] Date of Patent: Jul. 24, 1984

[54] CRANKCASE SUPERCHARGED FOUR CYCLE ENGINE WITH JET PUMP ASSIST

[75] Inventor: Benjamin L. Sheaffer, Oshkosh, Wis.

[73] Assignee: Brunswick Corporation, Skokie, Ill.

[21] Appl. No.: 452,153

[22] Filed: Dec. 22, 1982

[51] Int. Cl.[3] ..... F02B 33/06

[52] U.S. Cl. ..... 123/317; 123/318

[58] Field of Search ..... 123/317, 318

[56] References Cited

U.S. PATENT DOCUMENTS

| | | | |
|---|---|---|---|
| 931,976 | 8/1909 | Turner | 123/317 |
| 1,981,610 | 11/1934 | Bucklin | 123/317 |
| 3,257,996 | 6/1966 | Henrikson | 123/73 R |

FOREIGN PATENT DOCUMENTS

| | | | |
|---|---|---|---|
| 195683 | 2/1958 | Austria | 123/317 |
| 2708729 | 9/1978 | Fed. Rep. of Germany | 123/317 |
| 2741649 | 3/1979 | Fed. Rep. of Germany | 123/317 |

OTHER PUBLICATIONS

Article entitled "Webra T4 Four Cycle", pp. 32, 33, 34, 90, 91, of May, 1981, issue of Model Airplane News.

Article entitled "Improvement of Volumetric Efficiency of 4-Stroke Cycle Engine by Crankcase Supercharging", by Dr. Watanabe.

*Primary Examiner*—Wendell E. Burns

*Attorney, Agent, or Firm*—Andrus, Sceales, Starke & Sawall

[57] ABSTRACT

A crankcase supercharged four cycle engine (10) includes an outside air inlet port (22) positioned so that upon each expansion stroke of the piston (11) a charge of pressurized air is fed to the crankcase (15), and hence through a one-way valve (25) and nozzle (26) into an enclosed surge tank (28). A tuning pipe (30) disposed within the surge tank has an inlet (31) at the nozzle outlet and provides a tuned passage which connects for discharge through a valved port (20, 21) into the engine cylinder (12). On one downward stroke of the piston, air from the outside air inlet port is compressed into the crankcase and is forced through the one-way valve and nozzle to provide a charge of compressed air which is trapped within the surge tank and tuning pipe. On the next downward stroke of the piston, another charge of compressed air is forced through the nozzle and into the tuning pipe inlet. A venturi effect is created which draws the previous charge of air trapped in the surge tank into the tuning pipe, which increases the pressure within the tuning pipe for discharge through the valved port into the engine cylinder.

6 Claims, 5 Drawing Figures

CRANKCASE SUPERCHARGED FOUR CYCLE ENGINE WITH JET PUMP ASSIST

DESCRIPTION

Cross Reference To Related Application

A portion of the apparatus and methods disclosed in this application are disclosed and/or claimed in the following concurrently filed application:

Ser. No. 06/452,206, filed Dec. 22, 1982 in the name of Benjamin L. Sheaffer and entitled "Inlet Tuning of Crankcase Supercharged Four Cycle Engine".

TECHNICAL FIELD

The invention relates to a crankcase supercharged four cycle engine.

BACKGROUND ART

Supercharging of internal combustion engines has frequently been used to help the fuel burn more completely and to make the engine produce more power. The supercharging usually operates by compressing the air fed into the cylinder or cylinders, as by charging the crankcase. See, for example, the article entitled "Webra T4 Four Cycle" commencing at Page 32 of the May, 1981 issue of "Model Airplane News".

In addition, some prior engines have utilized a passage connecting a crankcase outlet with an air inlet to the engine cylinder to provide the supercharging function. A one way valve, such as a reed valve, has been positioned at the crankcase outlet, and an inlet pot or surge tank has been disposed centrally within the passage, as disclosed in a Japanese article by Dr. Watanabe entitled "Improvement of Volumetric Efficiency of 4-Stroke Cycle Engine by Crankcase Supercharging".

Furthermore, atmosphere-connected jet pumps have been used in two cycle engines, to assist in providing fuel-free air to the cylinder chamber of the engine, as in the Henrikson U.S. Pat. No. 3,257,996.

DISCLOSURE OF THE INVENTION

A crankcase supercharged four cycle engine includes an outside air inlet port positioned so that upon each expansion stroke of the piston a charge of pressurized air is fed to the crankcase, and hence through a one-way valve and nozzle into an enclosed surge tank. A tuning pipe disposed within the surge tank has an inlet at the nozzle outlet and provides a tuned passage which connects for discharge through a valved port into the engine cylinder.

On one downward stroke of the piston, air from the outside air inlet port is compressed into the crankcase and is forced through the one-way valve and nozzle to provide a charge of compressed air which is trapped within the surge tank and tuning pipe. On the next downward stroke of the piston, another charge of compressed air is forced through the nozzle and into the tuning pipe inlet. A venturi effect is created which draws the previous charge of air trapped in the surge tank into the tuning pipe, which increases the pressure within the tuning pipe for discharge through the valved port into the engine cylinder.

BEST MODE FOR CARRYING OUT THE INVENTION

Figure 1:
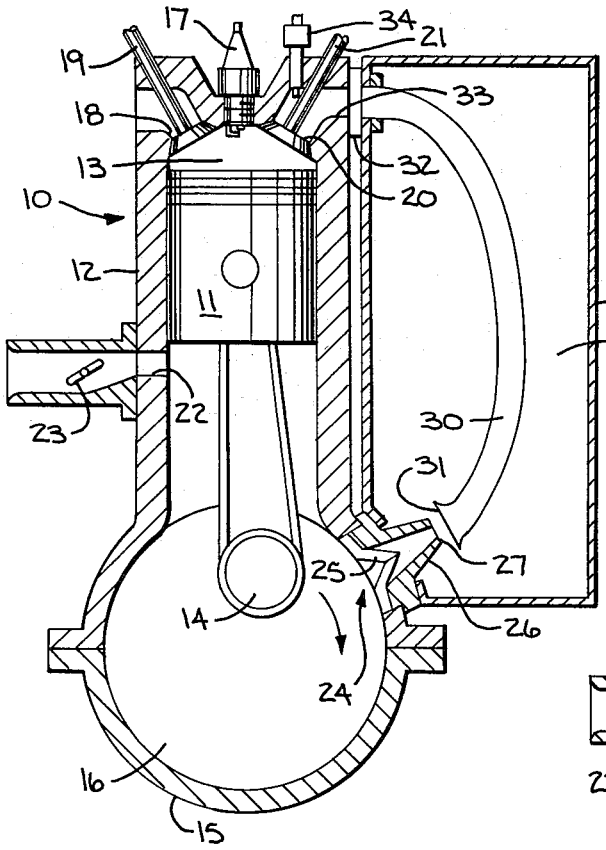
FIG. 1 is a schematic sectional view of a four cycle engine at the time of ignition.

A four cycle internal combustion engine 10 has at least one piston 11 contained within a cylinder 12 which forms a cylinder chamber 13. Piston 11 is reciprocably driven in the usual manner from a crankshaft 14 disposed in the engine crankcase 15, with the latter forming a crank chamber 16.

As shown, engine 10 is of the gasoline spark ignited type and its cylinder 12 includes a spark plug 17 mounted therein, an exhaust port 18 and associated valve 19, together with an inlet port 20 and associated valve 21.

For purposes of supercharging crankcase 15, a piston controlled air induction port 22 is disposed in the wall of cylinder 12 closely adjacent the bottom of piston 11 when the latter is in its extended position. Port 22 is adapted to communicate with crankcase chamber 16 when piston 11 is extended, but is blocked in other piston positions. Furthermore, port 22 communicates with the atmosphere via a butterfly throttle valve 23.

It is desired to significantly increase the air delivery ratio to cylinder chamber 13 as compared to that afforded by the usual crankcase supercharging. It is also desired to lower fuel consumption at part throttle.

For this purpose, crankcase chamber 16 is provided with an air outlet 24 which communicates through a one-way valve 25 with a nozzle 26. One-way valve 25 is shown as a reed valve at the throat of nozzle 26 which permits only discharge of air from crankcase 15. Nozzle 26 decreases in cross sectional area toward its outer end 27 and discharges into an essentially closed surge tank 28 which, in the present embodiment, is shown as mounted to engine 10. Surge tank 28 forms a chamber 29 and has disposed therein a tuning pipe 30 of any usual well-known type. Pipe 30 has a flared inlet 31 disposed closely adjacent and directly facing the discharge end 27 of nozzle 26, and which is open to chamber 29. In addition, pipe 30 forms an air passage which selectively connects chamber 29 to cylinder chamber 13. For this purpose, the discharge end of pipe 30 connects through a fitting 32 in the wall of surge tank 28 to a duct 33 in cylinder 12 which in turn leads to inlet port 20 for cylinder chamber 13.

A suitable gasoline injector 34 is connected to duct 33 to provide measured quantities of fuel to engine 10.

OPERATION

Referring to FIG. 1, which illustrates engine 10 at the time of ignition, piston 11 is in its extended position at the end of an upward stroke and air induction port 22 is open to connect crankcase chamber 16 with the atmosphere. Valves 19 and 21 are closed.

Figure 2:
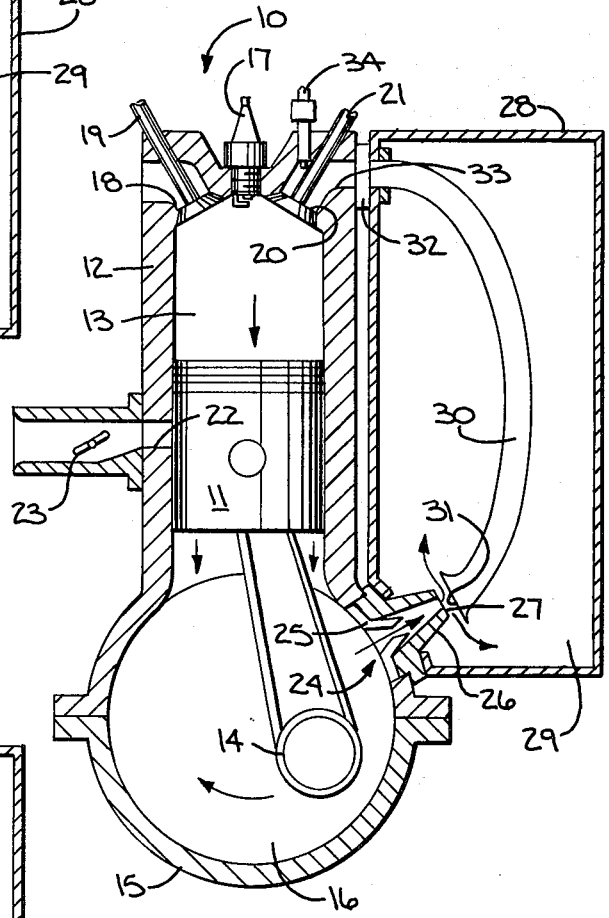
FIG. 2 is a view of the engine showing the expansion stroke of the piston after ignition.

Upon ignition, piston 11 is forced downwardly, blocking off port 22 and forcing air into crankcase 15. See FIG. 2. The air, being under compression, is forced through crankcase air outlet 24 and one-way valve 25 and hence through nozzle 26 into surge tank 28 to create a charge of compressed air, not only within tank chamber 29 but also within tuning pipe 30.

Figure 3:
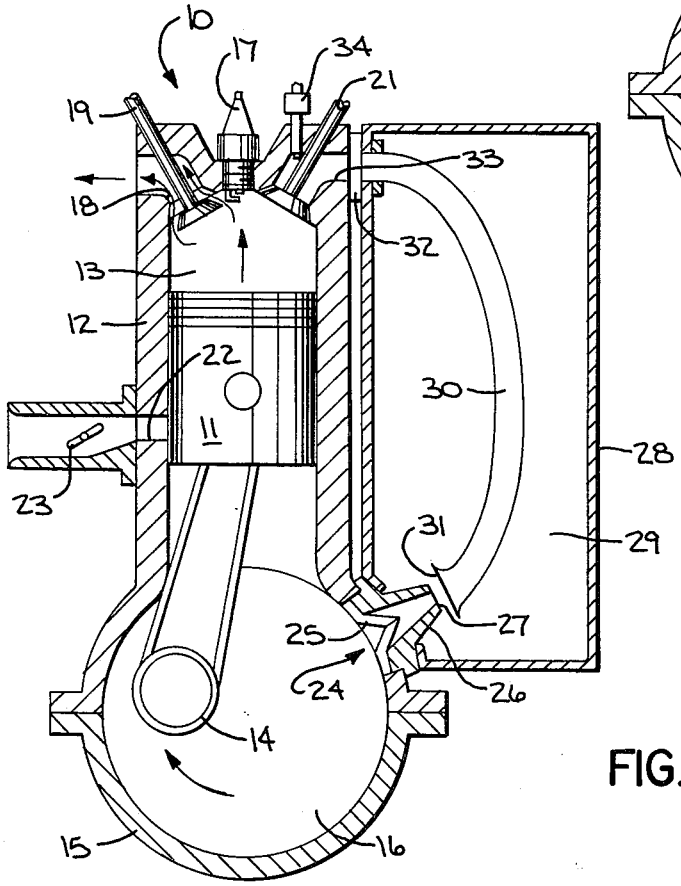
FIG. 3 is a view of the engine with the piston approaching the end of the exhaust stroke.

Immediately upon commencement of return of piston 11 in its exhaust stroke, one-way valve 25 closes to trap the charge of air in tank 28 and, with exhaust valve 19 open, the piston moves upwardly as shown in FIG. 3, and ultimately assumes its uppermost position with air induction port 22 again connecting crankcase chamber 16 to atmosphere.

Figure 4:
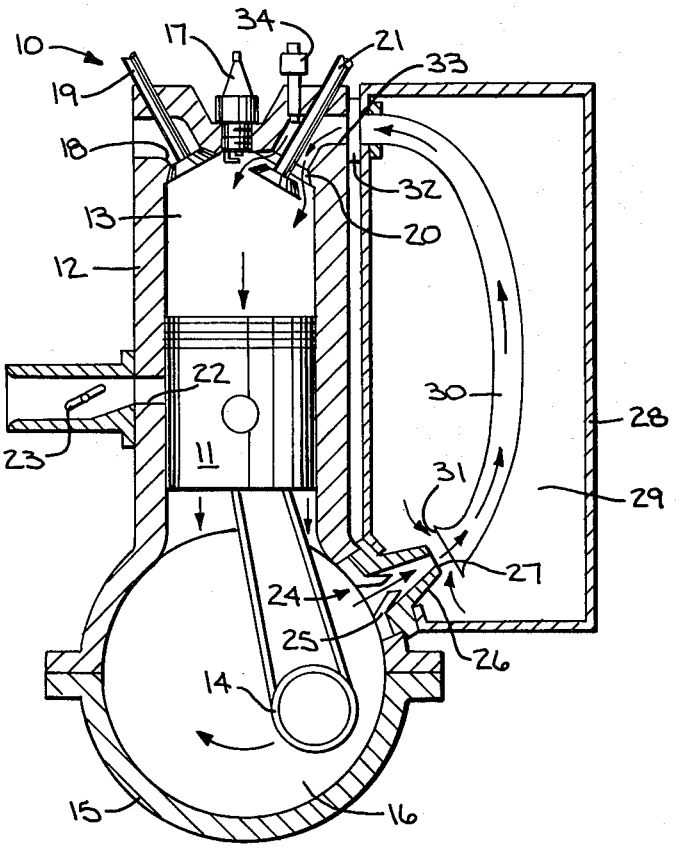
FIG. 4 is a view of the engine showing the next, or fuel intake, stroke.

During the next downward stroke of piston 11, air is again forced into crankcase 15 and hence through one-way valve 25 and nozzle 26. In this instance, however, fuel is substantially simultaneously injected by injector 34 into duct 33 and inlet valve 20 is open. See FIG. 4. The second charge of air discharging from nozzle 26 passes primarily into tuning pipe 30 and flows through the pipe toward cylinder 12. Furthermore, the construction is such that nozzle 26 and the flared inlet 31 cooperate to form a jet pump of the venturi type which draws the initially trapped charge of air in surge tank chamber 29 into tuning pipe 30 to thereby augment and amplify the compressed air flowing through the pipe passage and into engine cylinder 12.

Figure 5:
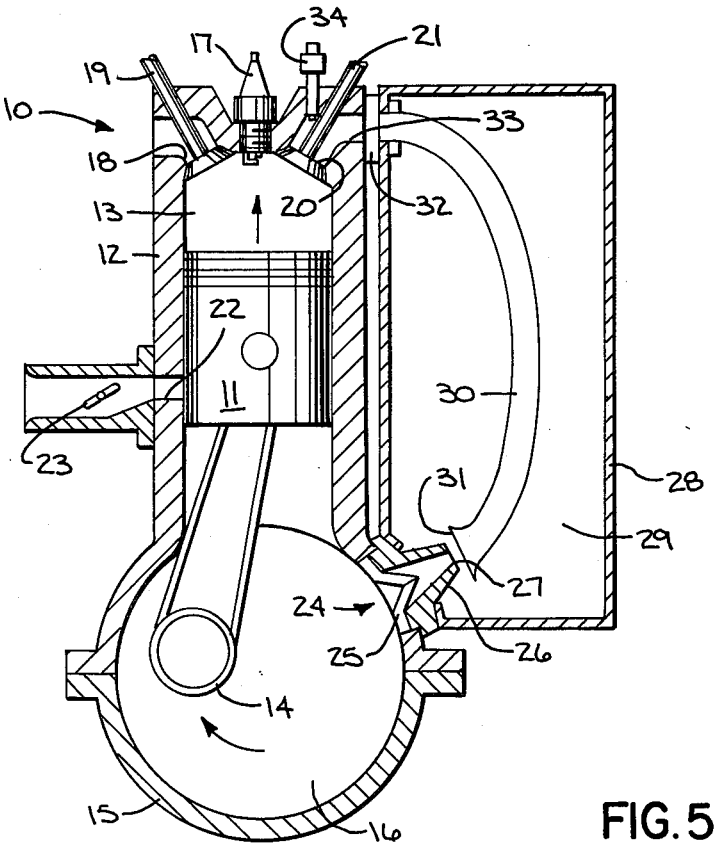
FIG. 5 is a view of the engine showing the compression stroke just prior to ignition.

Once piston 11 reaches the end of its second expansion stroke and surge tank 28 is essentially emptied of its charge of compressed air, the piston then enters into its compression stroke, as shown in FIG. 5, with valves 19, 21 and 25 all closed and air induction port 22 blocked. The system is then again ready for ignition, as in FIG. 1.

Certain modifications to the described structure may be made without changing the basic operation of the jet pump assist. For example, gas injector 34 could be replaced with a carburetor of any suitable design. In addition, air induction port 22 could be positioned in the wall of crankcase 15 instead of in cylinder 12, with piston controlled inlet valve means replaced by a one-way reed valve or crankshaft rotary valve. If the engine is of the diesel type, spark plug 17 could be replaced with a diesel injector.

I claim:

1. In a supercharged four cycle internal combustion engine having a crankcase, a piston reciprocable in a cylinder, a device for supplying fuel to said cylinder, and valved air inlet and exhaust ports in said cylinder, a cylinder air charging device comprising:

(a) an air induction port disposed in the wall of said engine and with said air induction port providing communication between said crankcase and the atmosphere when said piston is at a position at the end of its upward stroke, (b) an air outlet port disposed in said crankcase for receiving compressed air therethrough in response to each downward stroke of said piston, and (c) means connecting said air outlet port to said cylinder for selective compressed air flow therebetween, (d) said connecting means including air pressure amplifying means responsive to reciprocation of said piston to amplify the compression of air as the air flows from said air outlet port to said cylinder.

2. In a supercharged four cycle internal combustion engine having a crankcase, a piston reciprocable in a cylinder, a device for supplying fuel to said cylinder, and valved air inlet and exhaust ports in said cylinder, a cylinder air charging device comprising:

(a) an air induction port disposed in the wall of said engine and with said air induction port providing communication between said crankcase and the atmosphere when said piston is at a position at the end of its upward stroke, (b) an air outlet port disposed in said crankcase for receiving compressed air therethrough in response to each downward stroke of said piston, and (c) means connecting said air outlet port to said cylinder for selective compressed air flow therebetween, (d) said connecting means including air pressure amplifying means responsive to reciprocation of said piston to amplify the compression of air as the air flows from said air outlet port to said cylinder, (e) said connecting means including:

(1) a one-way valve disposed adjacent said crankcase air outlet port, (2) and an enclosed surge tank having a chamber disposed to receive the discharge of said one-way valve during a downward stroke of said piston.

3. The cylinder air charging device of claim 2 wherein said surge tank comprises means for holding a trapped charge of compressed air received from said one-way valve after one downward stroke of said piston.

4. In a supercharged four cycle internal combustion engine having a crankcase, a piston reciprocable in a cylinder, a device for supplying fuel to said cylinder, and valved air inlet and exhaust ports in said cylinder, a cylinder air charging device comprising:

(a) an air induction port disposed in the wall of said engine and with said air induction port providing communication between said crankcase and the atmosphere when said piston is at a position at the end of its upward stroke, (b) an air outlet port disposed in said crankcase for receiving compressed air therethrough in response to each downward stroke of said piston, and (c) means connecting said air outlet port to said cylinder for selective compressed air flow therebetween, (d) said connecting means including air pressure amplifying means responsive to reciprocation of said piston to amplify the compression of air as the air flows from said air outlet port to said cylinder, (e) said connecting means including:

(1) a one-way valve disposed adjacent said crankcase air outlet port, (2) and an enclosed surge tank having a chamber disposed to receive the discharge of said one-way valve during a downward stroke of said piston, (3) said surge tank comprising means for holding a trapped charge of compressed air received from said one-way valve after one downward stroke of said piston, (f) said air pressure amplifying means comprising:

(1) an air nozzle connected to said one-way valve and with said nozzle discharging into said surge tank, and (2) a tuning pipe having an open inlet disposed in said surge tank and facing said nozzle, said tuning pipe forming an air flow passage connected to said cylinder, (3) said nozzle and tuning pipe inlet forming venturi means for drawing the said trapped charge of compressed air from said surge tank chamber into said passage upon another downward stroke of said piston when said valved air inlet of said cylinder is open.

5. The cylinder air charging device of claim 4 in which the open inlet of said tuning pipe is flared.

6. In a supercharged four cycle internal combustion engine having a crankcase, a piston reciprocable in a cylinder, a device for supplying fuel to said cylinder, and valved air inlet and exhaust ports in said cylinder, a cylinder air charging device comprising:

(a) an air induction port disposed in the wall of said engine and with said air induction port providing communication between said crankcase and the atmosphere when said piston is at a position at the end of its upward stroke, (b) an air outlet port disposed in said crankcase for receiving compressed air therethrough in response to each downward stroke of said piston, (c) means connecting said air outlet port to said cylinder for selective compressed air flow therebetween, said connecting means including:

(1) an enclosed surge tank connected to said crankcase air outlet port, (2) and a tuning pipe having an open inlet disposed in said surge tank and an outlet connected to said cylinder, (d) and venturi means disposed in said surge tank and responsive to reciprocation of said piston to assist the flow of air between said surge tank and said tuning pipe.

* * * * *